US009173037B2

(12) United States Patent
Watanabe et al.

(10) Patent No.: US 9,173,037 B2
(45) Date of Patent: Oct. 27, 2015

(54) VIBRATING BODY FOR ACOUSTIC TRANSDUCER AND SPEAKER DEVICE

(75) Inventors: Kenya Watanabe, Yamagata (JP); Yoshihiro Kimura, Yamagata (JP); Masanori Ito, Yamagata (JP)

(73) Assignees: PIONEER CORPORATION, Tokyo (JP); TOHOKU PIONEER CORPORATION, Yamagata (JP)

( * ) Notice: Subject to any disclaimer, the term of this patent is extended or adjusted under 35 U.S.C. 154(b) by 265 days.

(21) Appl. No.: 12/919,458

(22) PCT Filed: Feb. 25, 2008

(86) PCT No.: PCT/JP2008/053200

§ 371 (c)(1), (2), (4) Date: Oct. 7, 2010

(87) PCT Pub. No.: WO2009/107192

PCT Pub. Date: Sep. 3, 2009

(65) Prior Publication Data

US 2011/0194724 A1 Aug. 11, 2011

(51) Int. Cl.

| | |
|---|---|
| ***H04R 25/00*** | (2006.01) |
| ***H04R 9/04*** | (2006.01) |
| ***H04R 7/20*** | (2006.01) |

(52) U.S. Cl.

CPC . *H04R 9/045* (2013.01); *H04R 7/20* (2013.01)

(58) Field of Classification Search

CPC ..... H04R 7/14; H04R 7/20; H04R 2307/207; H04R 2307/201; H04R 7/125; H04R 9/06; H04R 1/46; H04R 2307/025; H04R 2460/13; H04R 2499/13; H04R 2499/15; H04R 25/606; H04R 31/003; H04R 7/122; H04R 7/127; H04R 2209/027; H04R 9/045

USPC ..... 381/396, 398, 423–428, 430–432; 181/157, 164, 165, 167–174

See application file for complete search history.

(56) References Cited

U.S. PATENT DOCUMENTS

| | | | | |
|---|---|---|---|---|
| 4,428,996 | A * | 1/1984 | Miyoshi et al. | 428/198 |
| 6,510,232 | B2 | 1/2003 | Frasl | |
| 6,516,077 | B1 * | 2/2003 | Yamaguchi et al. | 381/424 |
| 6,957,714 | B2 * | 10/2005 | Takahashi et al. | 181/171 |
| 7,483,545 | B2 * | 1/2009 | Nagaoka | 381/423 |
| 7,801,324 | B2 * | 9/2010 | Kimura et al. | 381/430 |
| 8,259,987 | B2 * | 9/2012 | Omoda | 381/430 |

(Continued)

FOREIGN PATENT DOCUMENTS

| | | |
|---|---|---|
| CN | 1421114 A | 5/2003 |
| CN | 101002502 A | 7/2007 |

(Continued)

*Primary Examiner* — Davetta W Goins
*Assistant Examiner* — Phylesha Dabney
(74) *Attorney, Agent, or Firm* — Arent Fox LLP

(57) ABSTRACT

A vibrating body for an acoustic transducer is provided, in which the high resonance frequency associated with inverse resonance can be outside the audible range and which can improve the acoustic characteristic of a speaker device. The vibrating body 1 for an acoustic transducer includes: a diaphragm 2 including a first vibrating part 2*a* and a second vibrating part 2*b* formed in proximity of the outer circumferential edge of the first vibrating part 2*a*; and an edge portion 3 formed in proximity of the outer circumferential edge of the diaphragm 2. In the vibrating body 1 for an acoustic transducer, first reinforcing portions 6*a* and 6*b* are formed so as to extend from the second vibrating part 2*b* to the edge portion 3 in a radial direction.

16 Claims, 7 Drawing Sheets

(56) References Cited

U.S. PATENT DOCUMENTS

| | | | | |
|---|---|---|---|---|
| 2001/0010725 | A1 | 8/2001 | Frasl | |
| 2004/0007420 | A1* | 1/2004 | Takahashi et al. | 181/171 |
| 2006/0162993 | A1* | 7/2006 | Honda et al. | 181/172 |
| 2006/0233416 | A1* | 10/2006 | Howze | 381/398 |
| 2007/0209866 | A1 | 9/2007 | Frasl et al. | |
| 2010/0092023 | A1* | 4/2010 | Bryant et al. | 381/397 |
| 2011/0026757 | A1* | 2/2011 | Takahashi et al. | 381/397 |
| 2011/0311092 | A1* | 12/2011 | Kosuda et al. | 381/398 |

FOREIGN PATENT DOCUMENTS

| | | | |
|---|---|---|---|
| JP | 2-106794 | U | 8/1990 |
| JP | 05-183986 | A | 7/1993 |
| JP | 09-322289 | A | 12/1997 |
| JP | 2004-048494 | A | 2/2004 |
| JP | 2005-260537 | A | 9/2005 |
| JP | 2006-166070 | A | 6/2006 |
| JP | 2006-287418 | A | 10/2006 |
| WO | WO-2006/082754 | A1 | 8/2006 |

* cited by examiner

VIBRATING BODY FOR ACOUSTIC TRANSDUCER AND SPEAKER DEVICE

CROSS-REFERENCE TO RELATED APPLICATION

This application is a National Stage entry of International Application No. PCT/JP2008/053200, filed Feb. 25, 2008. The disclosure of the prior application is hereby incorporated in its entirety by reference.

FIELD OF THE INVENTION

The present invention relates to a vibrating body for an acoustic transducer that is used suitably for speaker devices mounted in a portable electronic device such as a mobile phone, a portable radio, and a PDA (Personal Digital Assistant). The invention also relates to a speaker device including the vibrating body for an acoustic transducer.

TECHNICAL BACKGROUND

Since portable electronic devices such as mobile phones, portable radios, and PDAs are designed for the purpose of portability, the devices are reduced in overall size or thickness. Therefore, the speaker devices used in such portable electronic devices also are reduced in size or thickness. Generally, the minimum resonance frequency $f_0$ of a speaker device are reduced to obtain an acoustic characteristic with small distortion over a wide frequency bandwidth.

To meet the demand for a reduction in thickness or size of such speaker devices, it is thought to reduce the weight of a diaphragm that vibrates in response to an electric signal applied to a voice coil and emits a sound wave (hereinafter referred to as "an acoustic wave"), the weight of an edge portion that is attached to the circumferential edge of the diaphragm to support the diaphragm, and the weight of other components. For example, the weights of the diaphragm, edge portion, and other components can be reduced by decreasing the thicknesses thereof.

However, when the thicknesses of the diaphragm, edge portion, or other components are reduced, these components are easily deformed, and a reduction in rigidity is, of course, caused. The rigidity is a physical quantity related to the resistance to deformation of a structural body. When the rigidity of the diaphragm, edge portion, or other components is small, a rolling phenomenon, a split vibration (split resonance), or other phenomenon is likely to occur. This results in, for example, an increase in incidental noise, occurrence of an unusual sound, and sound distortion, causing a problem in that good sound quality cannot be obtained.

Now, the rolling phenomenon means that the vibrating system of a speaker device does not linearly move up-and-down in an emission direction of an acoustic wave (a vibrating direction of a voice coil) in response to the electric signal applied to the voice coil and vibrates in a direction substantially perpendicular or oblique to the emission direction of the acoustic wave. In addition, the split vibration (split resonance) is a phenomenon that the diaphragm is bended and different parts of the diaphragm thereby vibrate differently. Furthermore, the split resonance is the following phenomenon. Vibrations created by the vibrational movement of the voice coil bobbin propagate concentrically from a central portion of the diaphragm toward a circumference of the diaphragm thereof. Then the vibrations are reflected from the edge portion and propagate in the reverse direction from the circumference of the diaphragm toward the central portion.

The vibrations reflected from the edge portion and subsequent vibrations propagating from the voice coil bobbin interfere with each other to cause the split resonance.

Therefore, a vibrating body for an acoustic transducer that has the following structure has previously been proposed to improve the rigidity of the edge portion included in the vibrating body for an acoustic transducer. More specifically, in this vibrating body for an acoustic transducer, a dome-shaped diaphragm is formed integrally with an edge portion disposed on the outer circumference thereof, and the edge portion includes a groove-shaped rib formed integrally therewith. In addition, an adjustment member that partially improve the bending strength of the edge portion is disposed on a part of the front or rear surface of the edge portion (see, for example, Patent Document 1). Hereinafter, this art is referred to as a first conventional example.

To provide a speaker device that can be reduced in size without an increase in the lowest resonance frequency $f_0$, a vibrating body for an acoustic transducer that has the following structure has previously been proposed. More specifically, in this vibrating body for an acoustic transducer, a first vibrating part that functions as a diaphragm is disposed at the center; a connection part to which a voice coil connects with the outer circumference of the first vibrating part; and an edge portion is disposed integrally on the outer circumference of the connection part. In addition, a second vibrating part that functions as a diaphragm is disposed on the outer circumferential side of the connection part so as to be continuous with the edge portion (see, for example, Patent Document 2). Hereinafter, this art is referred to as a second conventional example.

Moreover, a vibrating body for an acoustic transducer that has the following structure is proposed, the vibrating body can has a sufficient rigidity over the entire area of a dome-shaped diaphragm and reduce a fluctuation in a high tone frequency characteristic caused by a harmonic distortion and reproduce a sound in a high quality, even when dimensions of the dome shape is large. That is, in this vibrating body for an acoustic transducer, a dome-shaped diaphragm is supported by a frame via an edge portion formed integrally with the outer circumference of the diaphragm. The edge portion has, on its outer circumference, reinforcing ribs having convex/concave structure. The diaphragm has a groove- or a ridge-shaped reinforcing rib that is formed radially from the center of the dome so as to extend from the vicinity of the center of the dome toward the outer circumference of the dome (see, for example, Patent Document 3). Hereinafter, this art is referred to as a third conventional example.

[Patent Document 1] Japanese Patent Application Laid-Open No. 2004-048494 (claim 1, [0011], [0019] to [0025], FIGS. 1 and 2)

[Patent Document 2] Japanese Patent Application Laid-Open No. 2006-166070 (claim 1, [0011], [0017] to [0025], FIGS. 1 and 2)

[Patent Document 3] Japanese Patent Application Laid-Open No. 2006-287418, (claim 4, [0013], [0015] to [0020], FIGS. 2 and 3)

Problems to be Solved by the Invention

The above first to third conventional examples have a problem in that inverse resonance (an edge hole) occurs between the dome-shaped diaphragm and the edge portion. This inverse resonance is caused by a sound wave that propagates from the central portion of the diaphragm toward the edge portion in response to the vibration of the voice coil and a sound wave that return to the central portion from the edge portion of the diaphragm. In the acoustic characteristic (sound pressure level-frequency characteristic) of a speaker, the inverse resonance can appear as the high resonant frequency in the audible range. This results in a distortion in a high tune range, causing the deterioration of the acoustic characteristic of the speaker device, such as unclear sound quality in the high tune range.

The present invention has been made in view of the foregoing circumstances, and an exemplary object of the invention is to solve the foregoing problem. The invention aims to provide a vibrating body for an acoustic transducer and a speaker device that can solve these problems.

Means for Solving the Problems

To achieve the above object, the present invention comprises at least configurations according to the following independent claims.

A vibrating body for an acoustic transducer according to the invention described in claim 1 comprises: a diaphragm including a first vibrating part and a second vibrating part formed on an outer circumferential edge of the first vibrating part; and an edge portion formed in proximity of an outer circumferential edge of the diaphragm, wherein a first reinforcing portion is formed so as to extend from the second vibrating part to the edge portion in a radial direction.

A speaker device according to the invention described in claim 13 comprises: said vibrating body for an acoustic transducer according to any of claims 1 to 12; a magnetic circuit; and a frame that supports the vibrating body for an acoustic transducer.

BEST MODE FOR CARRYING OUT THE INVENTION

Embodiment 1

Figure 1A:
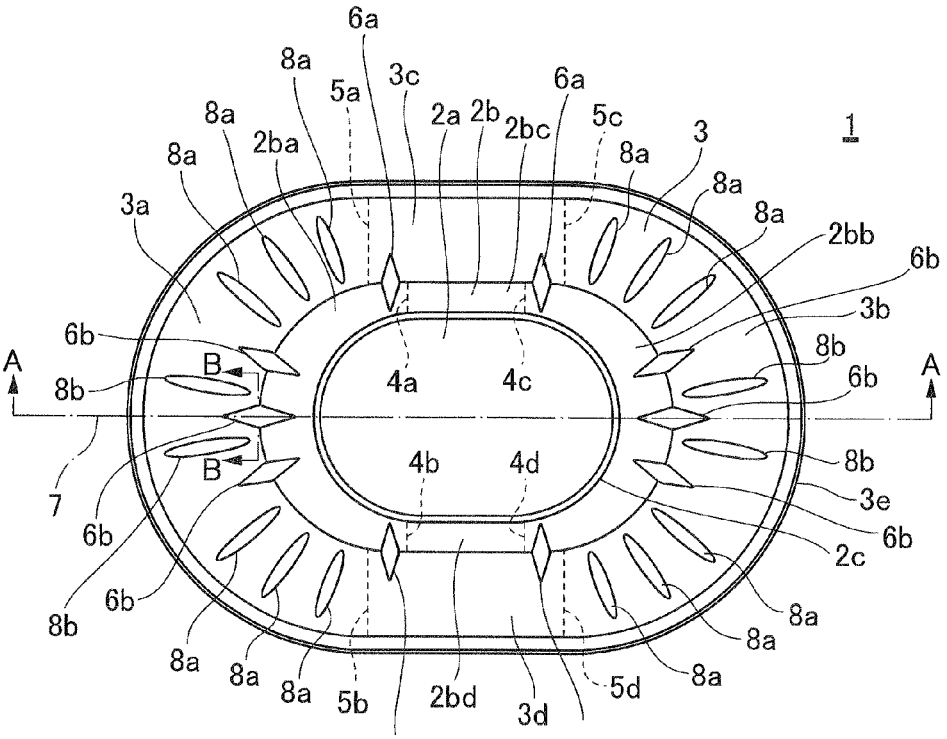
FIG. 1 is a set of schematic diagrams illustrating the structure of a vibrating body for an acoustic transducer according to Embodiment 1 of the present invention, FIG. 1(*a*) being a plan view, FIG. 1(*b*) being a cross-partial view taken along the line A-A in FIG. 1(*a*).
Figure 1B:
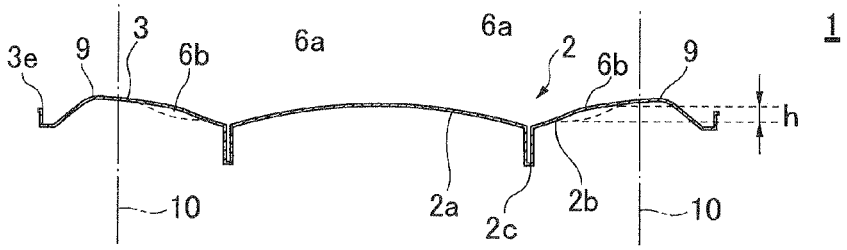
Figure 2:
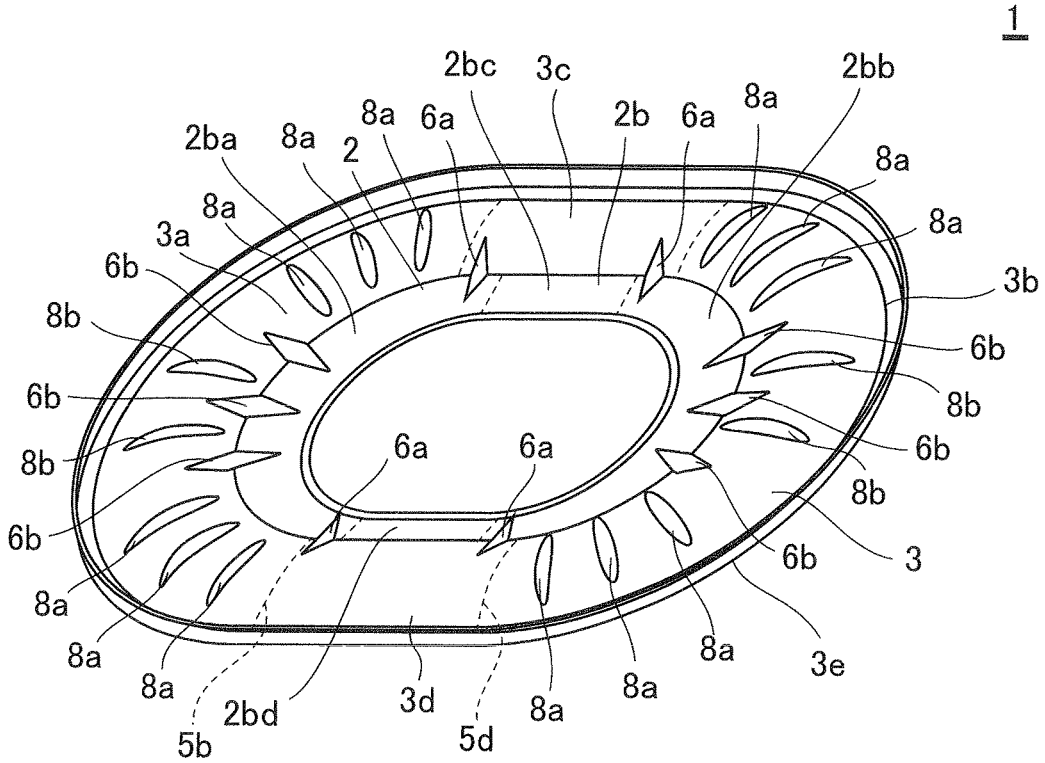
FIG. 2 is a perspective view illustrating the schematic structure of the vibrating body for an acoustic transducer shown in FIG. 1.

FIG. 1 is a set of schematic diagrams illustrating the structure of a vibrating body 1 for an acoustic transducer, according to Embodiment 1 of the present invention. FIG. 1(*a*) is a plan view, and FIG. 1(*b*) is a cross-partial view taken along the line A-A in FIG. 1(*a*). FIG. 2 is a perspective view illustrating the schematic structure of the vibrating body 1 for an acoustic transducer shown in FIG. 1. For example, the vibrating body 1 for an acoustic transducer is used for a speaker device mounted on a portable electronic device such as a mobile phone, a portable radio, and a PDA. The shorter diameter of such a speaker device is, for example, about 2 to 4 cm.

The vibrating body 1 for an acoustic transducer has, in plan view, a substantially track-like shape formed of two circular arcs and a rectangle interposed therebetween. The vibrating body 1 for an acoustic transducer includes a diaphragm 2 and an edge portion 3 that is formed integrally with the diaphragm 2. The diaphragm 2 includes a first vibrating part 2*a* having a substantially track-like shape in plan view and a second vibrating part 2*b* having a substantially hollow track-like shape in plan view. The first and second vibrating parts 2*a* and 2*b* are formed integrally, and a pocket 2*c* is interposed therebetween.

Herein, the substantially hollow track-like shape in plan view is a shape formed of two circular arc-shaped parts and two rectangles that have the similar to the circular arc-shaped parts in width and connect the ends of the circular arc-shaped parts thereof. The substantially hollow track-like shape is a shape that the first vibrating part 2*a* having the above substantially track-like shape and disposed substantially at the center thereof is hollowed out of. The vertical cross-part shape of the first vibrating part 2*a* is a substantially dome-like shape protruding toward the front side (in an acoustic radiation direction). The second vibrating part 2*b* includes two circular arc-shaped parts (first regions) 2*ba* and 2*bb* and two rectangular parts (second regions) 2*bc* and 2*bd* that have the similar to the circular arc-shaped parts 2*ba* and 2*bb* in width and connect with both ends of two rectangular parts, and the circular arc-shaped parts 2*ba* and 2*bb* are formed integrally with the rectangular parts 2*bc* and 2*bd*. The vertical cross-partial shape of the second vibrating part 2*b* is a substantially curved shape protruding toward the front side (in the acoustic radiation direction).

The pocket 2*c* has a substantially track ring-like shape in plan view. The substantially track ring-like shape is a substantially hollow track-like shape with a width extremely narrower than the entire circumferential length. The pocket 2*c* is configured to accommodate a voice coil (not shown) having a substantially track ring-like shape, and the voice coil is secured using an adhesive. Therefore, the pocket 2*c* has a depth enough to prevent the upper end of the accommodated voice coil from projecting from the connection portion with the first vibrating part 2*a*. The vibrating body 1 for an acoustic transducer having such a structure is referred to a pocket-type diaphragm.

The edge portion 3 is formed on the outer circumferential edge of the second vibrating part 2*b* so as to be integral with the diaphragm 2. The edge portion 3 has a substantially hollow track-like shape in plan view. More specifically, the edge portion 3 includes two circular arc-shaped parts (first regions) 3*a* and 3*b* and two rectangular parts (second regions) 3*c* and 3*d* that have the similar to the circular arc-shaped parts 3*a* and 3*d* in width and connect the both ends of the circular arc-shaped parts thereof, and the circular arc-shaped parts 3*a* and 3*b* are formed integrally with the rectangular parts 3*c* and 3*d*. The vertical cross-partial shape of the edge portion 3 is a substantially roll-like shape protruding toward the front side.

The area of the first vibrating part 2*a* is substantially equal to or less than the sum of the area of the second vibrating part 2*b* and the area of the edge portion 3. In the example shown in FIGS. 1 and 2, the sum of the area of the second vibrating part 2*b* and the area of the edge portion 3 is about 3.5 times larger than the area of the first vibrating part 2*a*.

The first vibrating part 2*a* has a substantially dome-like vertical cross-sectional shape protruding toward the front side (in the acoustic radiation direction), and the second vibrating part 2*b* has a substantially curved vertical cross partial shape protruding toward the front side (in the acoustic radiation direction). The edge portion 3 has a substantially roll-like vertical cross-partial shape protruding toward the front side. More specifically, all the first vibrating part 2*a*, the second vibrating part 2*b*, and the edge portion 3 have substantially curved vertical cross-sectional shapes protruding toward the front side (in the acoustic radiation direction). As shown in FIG. 1(*b*), the apex of the second vibrating part 2*b* is formed so as to be lower than the apex of the first vibrating part 2*a* or the apex 9 of the edge portion 3.

As shown in FIG. 1(*b*), the apex 9 of the edge portion 3 is formed so as to be positioned near the outer circumferential side in respect with the center 10 between the inner and outer circumferences of the edge portion 3.

A plurality of first reinforcing portions 6*a* and 6*b* being convex toward the front side (in the acoustic radiation direction) are formed across the boundary between the edge portion 3 and the second vibrating part 2*b*. In the example shown in FIGS. 1 and 2, one reinforcing portion 6*a* is formed near the circular arc-shaped part 2*ba* side in respect with a boundary 4*a* between the circular arc-shaped part 2*ba* and the rectangular part 2*bc* of the second vibrating part 2*b* and near the rectangular part 3*c* side in respect with a boundary 5*a* between the circular arc-shaped part 3*a* and the rectangular part 3*c* of the edge portion 3. Another reinforcing portion 6*a* is formed near the circular arc-shaped part 2*ba* side in respect with a boundary 4*b* between the circular arc-shaped part 2*ba* and the rectangular part 2*bd* and near the rectangular part 3*d* side in respect with a boundary 5*b* between the circular arc-shaped part 3*a* and the rectangular part 3*d*. In addition, another reinforcing portion 6*a* is formed near the circular arc-shaped part 2*bb* side in respect with a boundary 4*c* between the circular arc-shaped part 2*bb* and the rectangular part 2*bc* and near the rectangular part 3*c* side in respect with a boundary 5*c* between the circular arc-shaped part 3*b* and the rectangular part 3*c*. Moreover, another reinforcing portion 6*a* is formed near the circular arc-shaped part 2*bb* side in respect with a boundary 4*d* between the circular arc-shaped part 2*bb* and the rectangular part 2*bd* and near the rectangular part 3*d* side in respect with a boundary 5*d* between the circular arc-shaped part 3*b* and the rectangular part 3*d*. In other words, the first reinforcing portions 6*a* extend parallel to the shorter sides of the rectangular parts 2*bc*, 2*bd*, 3*c*, and 3*d*, respectively.

In the example shown in FIGS. 1 and 2, a plan view of an overall vibrating body 1 for an acoustic transducer including the edge portion 3 can be view as an ellipsoidal shape. First reinforcing portions 6*b* are formed on the long axis 7 of the ellipsoidal shape and substantially symmetrical positions with respect to the long axis 71*n* other words, the first reinforcing portion 6*b* extends from the second vibrating part 2*b* to the edge portion 3 substantially in the radial direction of the circular arc-shaped part such as the circular arc-shaped part 2*ba*, 2*bb*, 3*a*, and 3*b*. The first reinforcing portion 6*a* and 6*b* are formed on the substantially symmetrical positions with respect to the short axis, when a plan view of an overall vibrating body 1 for an acoustic transducer including the edge portion 3 can be view as the ellipsoidal shape.

Preferably, the height h of the first reinforcing portion 6*b* shown in FIG. 1(*b*) is substantially equal to or less than the height defined as a distance from the outer circumference of the second vibrating part 2*b* to the apex of the edge portion 3. Although not shown in the figure, the same is applied to the height of the first reinforcing portion 6*a*. The reason for this setting will be described below. The higher the heights of the first reinforcing portions 6*a* and 6*b* are, the more the inverse resonance can be suppressed, and the more the movement (the rolling phenomenon) of the first vibrating part 2*a* or the second vibrating part 2*b* in a horizontal direction (a direction substantially perpendicular to the vibration direction of the voice coil) can be suppressed. However, as the heights of the first reinforcing portions 6*a* and 6*b* increase, the rigidity of the edge portion 3 increases, i.e., the edge portion 3 comes to resist bending in the radial direction. Therefore, the response of the edge portion 3 to the vibration of the first vibrating part 2*a* and to the vibration of the second vibrating part 2*b* can be impaired (e.g., the first vibrating part 2*a* or the second vibrating part 2*b* comes to resist vibrating). When the heights of the first reinforcing portions 6*a* and 6*b* are substantially equal to or less than the height defined as a distance from the outer circumference of the second vibrating part 2*b* to the apex of the edge portion 3, the response of the edge portion 3 to the vibration of the first vibrating part 2*a* and to the vibration of the second vibrating part 2*b* can be relatively large. When the heights of the first reinforcing portions 6*a* and 6*b* are set to be comparatively short, for example, to about one-half the height defined as a distance from the outer circumference of the second vibrating part 2*b* to the apex of the edge portion 3, comparatively large rigidity can be ensured, and the inverse resonance can also be suppressed.

Preferably, each of the first reinforcing portions 6*a* and 6*b* has a polygonal shape in plan view. In the example shown in FIGS. 1 and 2, each of the first reinforcing portions 6*a* and 6*b* has a substantially rhombic shape (substantially rectangular shape) in plan view. When each of the first reinforcing portions 6*a* and 6*b* has a polygonal shape in plan view, the first reinforcing portions 6*a* and 6*b* are allowed to bend in the radial or circumferential direction of the circular arc-shaped parts 3*a* and 3*b*, and the occurrence of unnecessary vibrations (for example, the inverse resonance and rolling phenomenon) can thereby be suppressed.

Figure 3A:
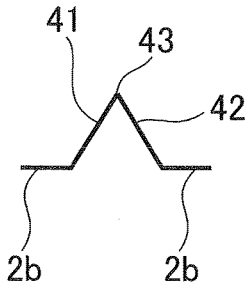
FIG. 3 is a set of cross-partial views taken along the line B-B in FIG. 1(*a*), FIG. 3(*a*) showing an example in which each first reinforcing portion has a substantially triangular cross-partial shape, FIG. 3(*b*) showing an example in which each first reinforcing portion has a substantially dome-like cross-partial shape.
Figure 3B:
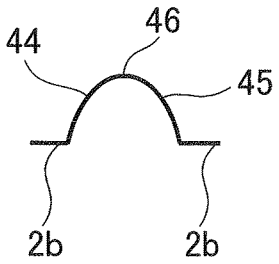

The cross-sectional shape of each of the first reinforcing portions 6*a* and 6*b* may be any of a substantially inverted V-shape, a substantially inverted U-shape, a substantially rectangular shape, a substantially sawtooth shape, and a substantially sinusoidal shape. FIG. 3 is a set of cross-sectional views taken along the line B-B in FIG. 1(*a*). FIG. 3(*a*) shows an example in which each first reinforcing portion 6*b* has a substantially inverted V-shaped cross-sectional shape, and FIG. 3(*b*) shows an example in which each first reinforcing portion 6*b* has a substantially inverted U-shaped cross-sectional shape. In the example shown in FIG. 3(*a*), the first reinforcing portion 6*b* includes straight inclined surfaces 41 and 42 that come in contact with each other to form an apex 43. In the example shown in FIG. 3(*b*), the first reinforcing portion 6*b* includes curved inclined surfaces 44 and 45 that come in contact with each other to form an apex 46.

A plurality of second reinforcing portions 8*a* and 8*b* being convex toward the rear side (in the direction opposite to the acoustic radiation direction) are formed in the circular arc-shaped parts 3*a* and 3*b*. The cross-sectional shape of each of the second reinforcing portions 8*a* and 8*b* may be any of a substantially inverted V-shape, a substantially inverted U-shape, a substantially rectangular shape, a substantially sawtooth shape, and a substantially sinusoidal shape.

The lengths of the second reinforcing portions 8*a* and 8*b* are slightly less than the widths of the circular arc-shaped parts 3*a* and 3*b*. The minimum resonance frequency $f_0$ can be adjusted to the desired value by arranging the second reinforcing portions 8*a* and 8*b*. More specifically, when the length of the second reinforcing portions 8*a* and 8*b* is extremely long, it is difficult to adjust the minimum resonance frequency $f_0$. When the length of the second reinforcing portions 8*a* and 8*b* is short, the second reinforcing portions 8*a* and 8*b* resist bending in the circular arc-shaped parts 3*a* and 3*b*, and the vibrations of the diaphragm 2 are thereby suppressed, so that the vibrations of the voice coil are not well transmitted to the diaphragm 2. In the example shown, the lengths of the second reinforcing portions 8*a* and 8*b* are slightly less than the widths of the circular arc-shaped parts 3*a* and 3*b*, and the minimum resonance frequency $f_0$ can thereby be adjusted to the desired value.

In the example shown in FIGS. 1 and 2, three second reinforcing portions 8*a* are formed at predetermined intervals in a region extending from the boundary 4*a* between the circular arc-shaped part 3*a* and the rectangular part 3*c* to the long axis 7, and three second reinforcing portions 8*a* are formed at predetermined intervals in a region extending from the boundary 4*b* between the circular arc-shaped part 3*a* and the rectangular part 3*d* to the long axis 7. Similarly, in the example shown in FIGS. 1 and 2, three second reinforcing portions 8*a* are formed at predetermined intervals in a region extending from the boundary 4*c* between the circular arc-shaped part 3*b* and the rectangular part 3*c* to the long axis 7, and three second reinforcing portions 8*a* are formed at predetermined intervals in a region extending from the boundary 4*d* between the circular arc-shaped part 3*b* and the rectangular part 3*d* to the long axis 7. In the example shown in FIGS. 1 and 2, two second reinforcing portions 8*b* are formed in the circular arc-shaped part 3*a* in the substantially symmetric position with respect to the long axis 7. Similarly, two second reinforcing portions 8*b* are formed in the circular arc-shaped part 3*b* in the substantially symmetric position with respect to the long axis 7. In other words, the second reinforcing portions 8*a* and 8*b* extend in the radial directions of the circular arc-shaped parts 3*a* and 3*b*. The second reinforcing portions 8*a* and 8*b* described above are formed so as to be substantially symmetric with respect to the short axis (not shown) of the ellipsoidal shape, in plan view, of the vibrating body 1 for an acoustic transducer including the edge portion 3.

A bent part 3*e* being bent substantially perpendicularly in the front side (in the acoustic radiation direction) is formed on the outer circumference of the edge portion 3. Since the bent part 3*e* is formed, the vibrating body 1 for an acoustic transducer can be easily mounted on a frame (not shown) with high accuracy when a speaker device is assembled using the vibrating body 1 for an acoustic transducer. More specifically, the bent part 3*e* plays a role of positioning.

The diaphragm 2, the edge portion 3, the first reinforcing portions 6*a* and 6*b*, and the second reinforcing portions 8*a* and 8*b* described above are formed integrally by, for example, press forming. Examples of the material for the diaphragm 2 and the edge portion 3 include paper, woven fabrics including a fiber, knitted products including a fiber, non-woven fabrics, the woven fabrics impregnated with binding resin such as silicone resin, a metal material, a synthetic resin, an acrylic foam, and a hybrid material formed of a synthetic resin and a metal. Examples of the metal materials include aluminum, titanium, duralumin, beryllium, magnesium, and alloys thereof. Examples of the synthetic resin include polypropylene, polyethylene, polystyrene, polyethylene terephthalate, polyethylene naphthalate, polymethylmethacrylate, polycarbonate, polyallylate, epoxy resin, polysulfone, polyurethane having a urethane bond, and rubber. The acrylic foam, which is foamed resin, is formed using, for example, methyl methacrylate, methacrylic acid, styrene, maleic anhydride, and methacrylamide as raw materials. The vibrating body 2 and the edge portion 3 can be made of known foamed resins. The hybrid material is formed of, for example, a synthetic resin such as polypropylene and a metal such as tungsten.

As described above, in the vibrating body 1 for an acoustic transducer according to Embodiment 1 of the present invention, the first reinforcing portions 6*a* and 6*b* are formed so as to extend from the second vibrating part 2*b* to the edge portion 3. This allows the high resonance frequency associated with the inverse resonance to be outside the audible range, and the acoustic characteristic of a speaker device including the vibrating body 1 for an acoustic transducer can thereby be improved. Moreover, since the first reinforcing portions 6*a* and 6*b* extend substantially in the radial directions of the circular arc-shaped parts 2*ba*, 2*bb*, 3*a*, and 3*b*, the rigidity at the boundary between the second vibrating part 2*b* and the edge portion 3 is large, and this allows the entire vibrating body 1 for an acoustic transducer to vibrate in substantially the same phase. Therefore, a speaker device including the vibrating body 1 for an acoustic transducer can have a flat frequency characteristic.

Moreover, since the first reinforcing portions 6*a* and 6*b* can bend in the radial or circumferential directions of the circular arc-shaped parts 3*a* and 3*b*, the occurrence of unnecessary vibration such as the inverse resonance can be suppressed. When the vibrating body 1 for an acoustic transducer vibrates, the first reinforcing portions 6*a* and 6*b* can bend, and this allows the edge portion 3 to vibrate in response to the vibration of the first vibrating part 2*a* and the vibration of the second vibrating part 2*b*.

A plurality of first reinforcing portions 6*b* (three in the example shown in FIGS. 1 and 2) are formed so as to extend from the circular arc-shaped part 2*ba* of the second vibrating part 2*b* to the circular arc-shaped part 3*a* of the edge portion 3, and from the circular arc-shaped part 2*bb* of the second vibrating part 2*b* to the circular arc-shaped part 3*b* of the edge portion 3. Therefore, the rigidity in the vicinity of the boundary (bonding portion) between the circular arc-shaped part 3*a* and the circular arc-shaped part 2*ba* can be relatively large, and accordingly, the stress can be prevented from concentrating in the vicinity of the boundary when driving the vibrating body 1 for an acoustic transducer. This can prevent the occurrence of unnecessary movement in the vibrating body 1 for an acoustic transducer.

In the vibrating body 1 for an acoustic transducer according to Embodiment 1 of the present invention, the area of the first vibrating part 2*a* is substantially equal to or less than the sum of the area of the second vibrating part 2*b* and the area of the edge portion 3. With this configuration, when a speaker device is assembled using the vibrating body 1 for an acoustic transducer, a magnetic circuit of the external magnetic type can be used. When a magnetic circuit of the external magnetic type is used, the outer diameter of the magnet of the magnetic circuit can be greater than that when a magnetic circuit of the internal magnetic type is used. Therefore, the magnetic flux density of the magnetic field generated by the magnet can be large, and the sensitivity of the speaker device can thereby be increased. When a magnetic circuit of the internal magnetic type is used, on the other hand, the width of the edge portion (the difference between the outer and inner diameters) is small, and accordingly, it is difficult to increase the rigidity of the edge portion.

In the vibrating body 1 for an acoustic transducer according to Embodiment 1 of the present invention, vertical cross-sectional shapes of the first vibrating part 2*a*, the second vibrating part 2*b*, and the edge portion 3 have substantially curved shapes protruding toward the front side (in the acoustic radiation direction). The apex of the second vibrating part 2*b* is formed so as to be lower than the apex of the first vibrating part 2*a* or the apex of the edge portion 3. Moreover, the height of the outer circumference of the second vibrating part 2*b* is substantially equal to the height of the outer circumference of the first vibrating part 2*a*. With this configuration, the phase of the acoustic wave emitted from the second vibrating part 2*b* is substantially the same as the phase of the acoustic wave emitted from the first vibrating part 2*a*. In particular, when the height of the apex of the first vibrating part 2*a* is substantially the same as the height of the apex of the second vibrating part 2*b* and the height of the outer circumference of the first vibrating part 2*a* is substantially the same as the height of the outer circumference of the second vibrating part 2*b*, the difference in phase between the acoustic waves emitted from the first and second vibrating parts 2*a* and 2*b* can be comparatively small.

In the vibrating body 1 for an acoustic transducer according to Embodiment 1 of the present invention, the apex of the edge portion 3 is formed so as to be located on the outer circumferential side in respect with the center between the inner and outer circumferences of the edge portion 3. With this configuration, the effective vibrating area of the vibrating body 1 for an acoustic transducer can be large, and the sound pressure can thereby be increased.

In the vibrating body 1 for an acoustic transducer according to Embodiment 1 of the present invention, the first reinforcing portions 6*a* and 6*b* are formed so as to be convex toward the front side (in the acoustic radiation direction). Therefore, the occurrence of such inverse resonance that the first vibrating part 2*a* and the second vibrating part 2*b* vibrate in mutually opposite directions can be suppressed.

In the vibrating body 1 for an acoustic transducer according to Embodiment 1 of the present invention, the second reinforcing portions 8*a* and 8*b* are formed so as to be convex toward the rear side (in the direction opposite to the acoustic radiation direction). Therefore, the edge portion 3 can have relatively large rigidity, and the response of the edge portion 3 to the vibration of the first vibrating part 2*a* and to the vibration of the second vibrating part 2*b* can be comparatively high.

In the vibrating body 1 for an acoustic transducer according to Embodiment 1 of the present invention, the second reinforcing portions 8*a* and 8*b* extend in the radial directions of the circular arc-shaped parts 3*a* and 3*b*. Therefore, the rigidity of the edge portion 3 can be adjusted, i.e., the rigidity of the vibrating body 1 can be adjusted. This enables the adjustment of the minimum resonance frequency $f_0$. By forming the second reinforcing portions 8*a* and 8*b*, unnecessary movement, such as a vibration in a circumferential direction, in the vibrating body 1 for an acoustic transducer can be more suppressed as compared to the case where the second reinforcing portions 8*a* and 8*b* are not formed. For example, when a vibration in a circumferential direction is transmitted to the second vibrating part 2*b* and the edge portion 3 during the vibrations of the vibrating body 1 for an acoustic transducer, the widths of the second reinforcing portions 8*a* and 8*b* are reduced or increased in the circumferential direction, i.e., the second reinforcing portions 8*a* and 8*b* are expanded or contracted. This can suppress the occurrence of circumferential vibrations.

The reason that no second reinforcing portions 8*a* and 8*b* are provided in the rectangular parts 3*c* and 3*d* is described below. If second reinforcing portions 8*a* and 8*b* are provided also in the rectangular parts 3*c* and 3*d*, the rigidity of the rectangular parts 3*c* and 3*d* (in the short axis direction) provided with the second reinforcing portions 8*a* and 8*b* is greater than the rigidity of the circular arc-shaped parts 3*a* and 3*b* (in the major axis direction) provided with the second reinforcing portions 8*a* and 8*b*. Therefore, unnecessary movement such as the rolling phenomenon is more likely to occur in the vibrating body 1 for an acoustic transducer. This mechanism may be supposed as follows. The second reinforcing portions 8*a* and 8*b* have grooves having a V-shaped cross-sectional shape, and the taps of the grooves of the second reinforcing portions 8*a* and 8*b* are opened and closed in the circumferential direction by the vibrations propagating in the circumferential direction. When the taps of the grooves are opened and closed, the rigidity of the circular arc-shaped parts 3*a* and 3*b* becomes comparatively small. Accordingly, the vibration is easily transmitted in the long axis direction or amplified, so that unnecessary movement such as the rolling phenomenon may be more likely to occur in the vibrating body 1 for an acoustic transducer. This is the reason why no second reinforcing portions 8*a* and 8*b* are provided in the rectangular parts 3*c* and 3*d*.

In the vibrating body 1 for an acoustic transducer according to Embodiment 1 of the present invention, three first reinforcing portions 6*b* and two second reinforcing portions 8*b* are disposed alternately so that one portion is sandwiched between other portions. With this configuration, each of the first reinforcing portions 6*b* and the second reinforcing portions 8*b* can be formed to have a size large enough to exert its intended function. However, when the first reinforcing portion 6*b* and the second reinforcing portion 8*b* are formed continuously with each other, the first reinforcing portions 6*b* or the second reinforcing portions 8*b* must be formed to have a small size when the sizes and other factors of the second vibrating part 2*b* and the edge portion 3 are taken into consideration. For example, when the first reinforcing portion 6*b* is formed to have a small size, or a speaker device is constructed with the vibrating body 1 for an acoustic transducer, resonance or inverse resonance occurs and a peak-dip in the high tune range become large. This may result in deterioration in acoustic characteristic. When the convex first reinforcing portion 6*b* and the concave second reinforcing portion 8*b* are formed continuously with each other, a bending point is formed on the boundary between the first reinforcing portion 6*b* and the second reinforcing portion 8*b*. Therefore, stress acts on this bending point, and this may result in damage to the diaphragm 2.

Embodiment 2

Figure 4:
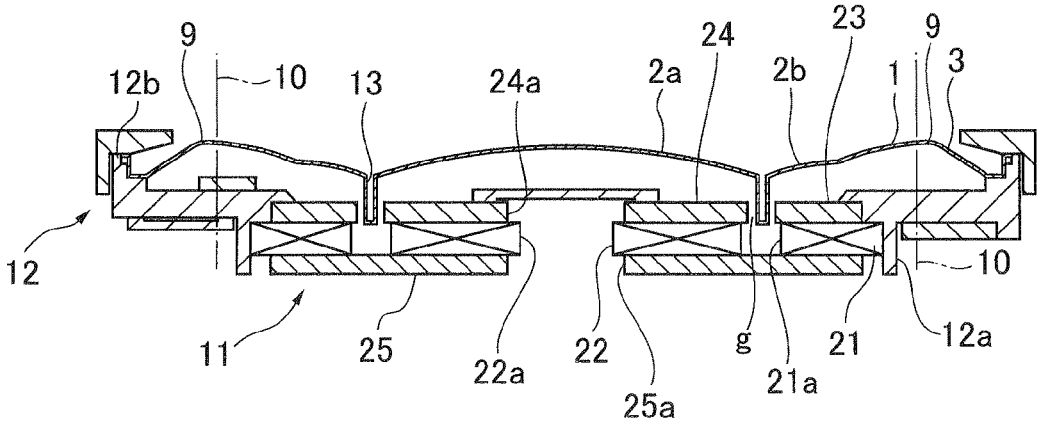
FIG. 4 is a cross-partial view illustrating the schematic structure of a speaker device according to Embodiment 2 of the present invention.
Figure 5A:
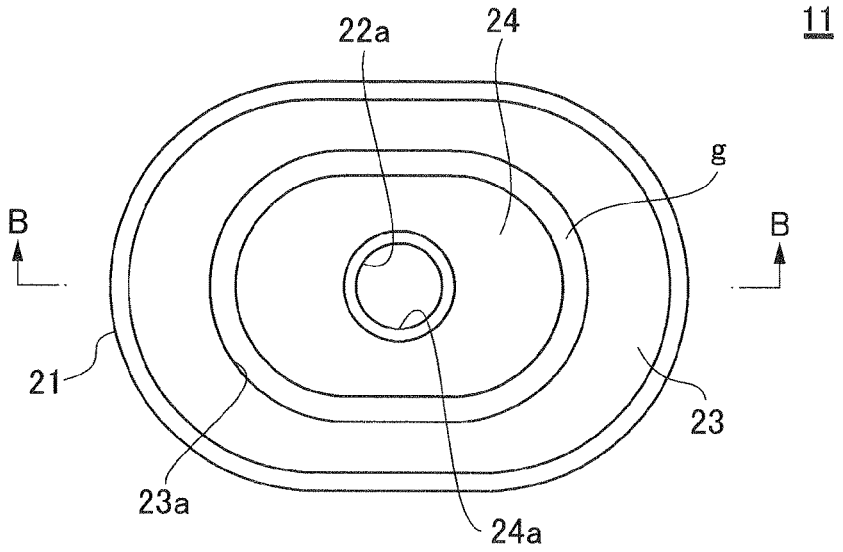
FIG. 5 is a set of schematic diagrams illustrating the structure of a magnetic circuit included in the speaker device shown in FIG. 4, FIG. 5(*a*) being a plan view, FIG. 5(*b*) being a front view, FIG. 5(*c*) being a cross-partial view taken along the line B-B in FIG. 5(*a*).
Figure 5B:
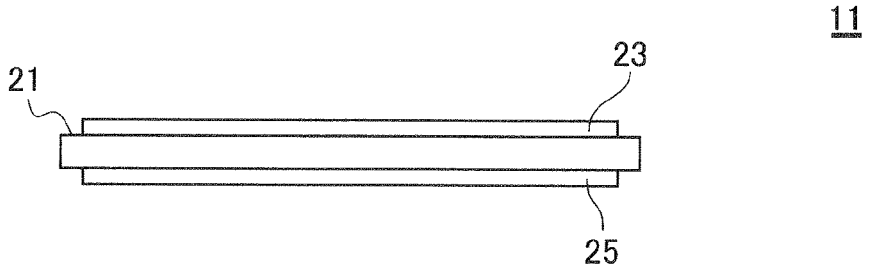
Figure 5C:
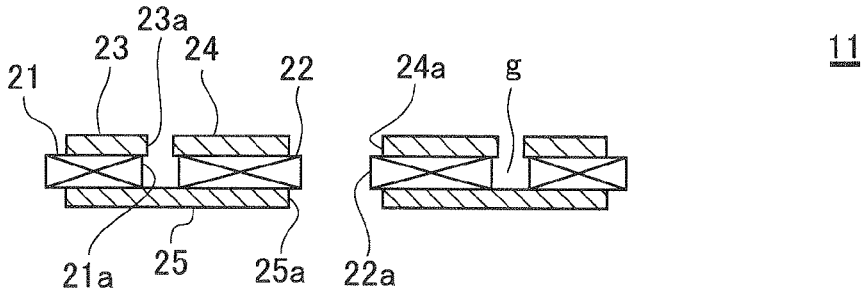

FIG. 4 is a cross-partial view illustrating the schematic structure of a speaker device according to Embodiment 2 of the present invention. FIG. 5 is a set of schematic diagrams illustrating the structure of a magnetic circuit included in the speaker device shown in FIG. 4. FIG. 5(*a*) is a plan view, FIG. 5(*b*) is a front view, and FIG. 5(*c*) is a cross-partial view taken along the line B-B in FIG. 5(*a*). The speaker device according to Embodiment 2 is mounted on a portable electronic device such as a mobile phone, a portable radio, or a PDA. The short diameter of the speaker device is, for example, about 2 to 4 cm. The speaker device according to Embodiment 2 includes the vibrating body 1 for an acoustic transducer according to Embodiment 1 described above, a magnetic circuit 11, and a frame 12. In FIGS. 4 and 5, parts corresponding to those in FIGS. 1 and 2 are denoted by the same reference numerals, and the description thereof is omitted.

The pocket 2*c* of the vibrating body 1 for an acoustic transducer accommodates a voice coil 13 having a substantially track ring-like shape, and the voice coil 13 is fixed with an adhesive. The magnetic circuit 11 is of the internal and external magnetic type. More specifically, a magnetic gap g is formed between an external magnet 21 and an internal magnet 22, and the external magnet 21 and the internal magnet 22 are sandwiched between a yoke 25 and corresponding external and internal plates 23 and 24.

The external magnet 21 and the internal magnet 22 are each, for example, a permanent magnet such as a neodymium, samarium-cobalt, alnico, or ferrite magnet. Both the external magnet 21 and the internal magnet 22 have substantially hollow track-like shapes in plan view. A through hole 21*a* having a substantially track-like shape is formed on the inner side of the external magnet 21. A through hole 22*a* having a substantially cylindrical shape is formed on the inner side of the internal magnet 22.

The external plate 23 and the internal plate 24 are formed of a magnetic material such as iron. The external plate 23 and the internal plate 24 have a substantially hollow track-like shape in plan view. The shape of the external plate 23 in plan view is geometrically similar to the shape of the external magnet 21 in plan view, and the shape of the internal plate 24 in plan view is geometrically similar to the shape of the internal magnet 22 in plan view. More specifically, the external plate 23 is slightly shorter than the external magnet 21 in both the long and short axis directions, while, the internal plate 24 is slightly longer than the internal magnet 22 in both the long and short axis directions.

A through hole 23*a* having a substantially track-like shape is formed substantially at the center of the external plate 23. The outer long and short diameters of the through hole 23*a* are slightly smaller than those of the through hole 21*a*. A through hole 24*a* having a substantially cylindrical shape is formed on the inner side of the internal plate 24. The outer long and short diameters of the through hole 24*a* are slightly larger than those of the through hole 22*a*. The external plate 23 is fixed on the upper surface of the external magnet 21 using, for example, an adhesive. Similarly, the internal plate 24 is fixed on the upper surface of the internal magnet 22 using, for example, an adhesive.

The yoke 25 is formed of a magnetic material such as pure iron, oxygen-free steel, or silicon steel. The yoke 25 has a substantially track-like shape in plan view. More specifically, the outer circumferential shape of the yoke 25 in plan view is geometrically similar to the outer circumferential shape of the external magnet 21 in plan view and is slightly smaller than the outer circumferential shape of the external magnet 21 in plan view in both the long and short axis directions. A through hole 25*a* having a substantially cylindrical shape is formed on the inner side of the yoke 25. The outer diameter of the through hole 25*a* is slightly greater than the outer diameter of the through hole 22*a*. The yoke 25 is fixed on the upper surfaces of the external magnet 21 and the internal magnet 22 through, for example, an adhesive.

The frame 12 is formed of, for example, an iron-series metal, a non-ferrous metal, an alloy thereof, or a synthetic resin. Examples of the iron-based metal include pure iron, oxygen-free steel, and silicon steel. Examples of the non-ferrous metal include aluminum, magnesium, and zinc. Examples of the synthetic resin include an olefin-series thermoplastic resin such as polypropylene, ABS (acrylonitrile-butadiene-styrene) resin, and polyethylene terephthalate-series thermoplastic resin, and other thermoplastic resins. The frame 12 is formed by, for example, draw molding of an iron-series metal, die-casting of a non-ferrous metal or an alloy thereof, or injection molding of a synthetic resin.

The frame 12 has a substantially track-like overall shape in plan view. The frame 12 has: a step part 12*a* to which the outer circumferential edge of the external magnet 21 is secured; and a step part 12*b* to which the bent part 3*e* formed on the outer circumference part of the edge portion 3 of the vibrating body 1 for an acoustic transducer is attached. The outer circumferential edge of the external magnet 21 of the magnetic circuit 11 is secured to the step part 12*a*, and the bent part 3*e* of the edge portion 3 is attached to the step part 12*b*. As shown in FIG. 4, the lower portion of the pocket 2*c* in which the voice coil 13 is accommodated is inserted into the magnetic gap g.

As described above, in Embodiment 2 of the present invention, the vibrating body 1 for an acoustic transducer according to Embodiment 1 described above and the magnetic circuit 11 of the internal and external magnetic type constitutes the speaker device. In the vibrating body 1 for an acoustic transducer, the second vibrating part 2*b* is larger than the first vibrating part 2*a*, and the plurality of first reinforcing portions 6*a* and 6*b* are formed so as to extend from the second vibrating part 2*b* to the edge portion 3. In addition, the plurality of second reinforcing portions 8*a* and 8*b* are formed in the edge portion 3. Therefore, according to Embodiment 2 of the present invention, the sensitivity of the speaker device can be increased, and deterioration in the acoustic characteristic of the speaker device can be suppressed. Moreover, the occurrence of unnecessary movement (such as the rolling phenomenon) in the pocket 2*c* in which the voice coil 13 is accommodated can be suppressed.

Embodiment 3

Figure 6:
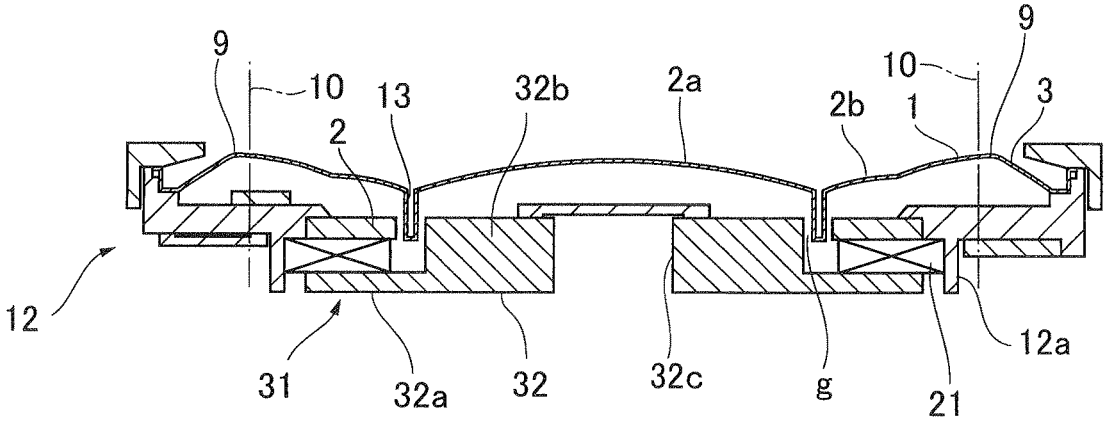
FIG. 6 is a cross-partial view illustrating the schematic structure of a speaker device according to Embodiment 3 of the present invention.
Figure 7A:
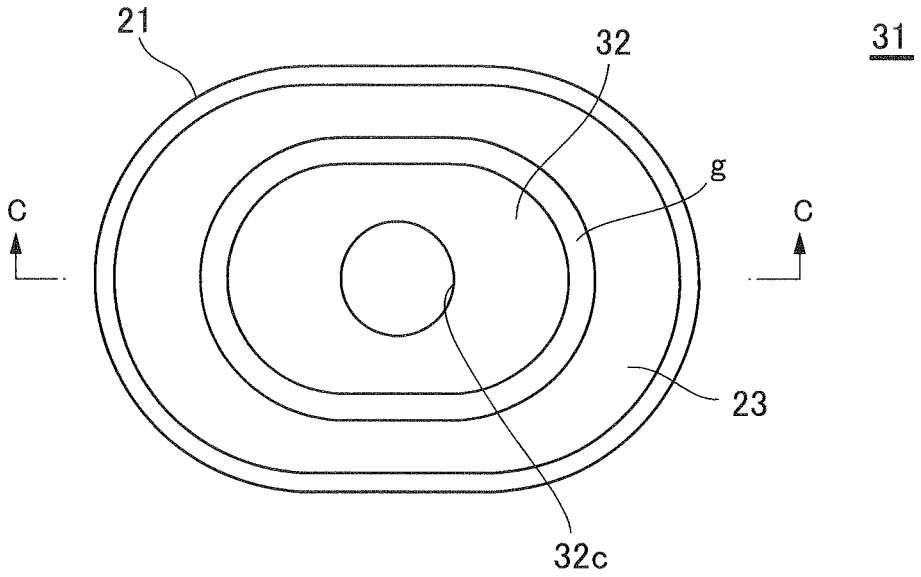
FIG. 7 is a set of schematic diagrams illustrating the structure magnetic circuit included in the speaker device shown in FIG. 6, FIG. 7(*a*) being a plan view, FIG. 7(*b*) being a front view, FIG. 7(*c*) being a cross-partial view taken along the line C-C in FIG. 7(*a*).
Figure 7B:
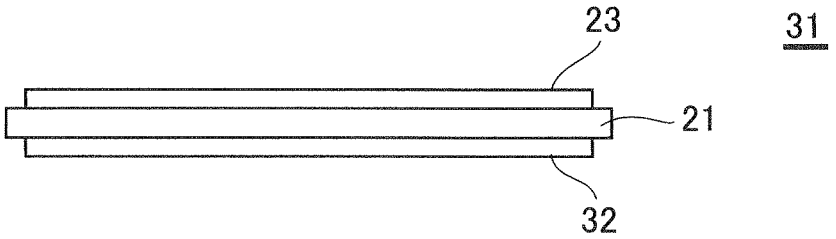
Figure 7C:
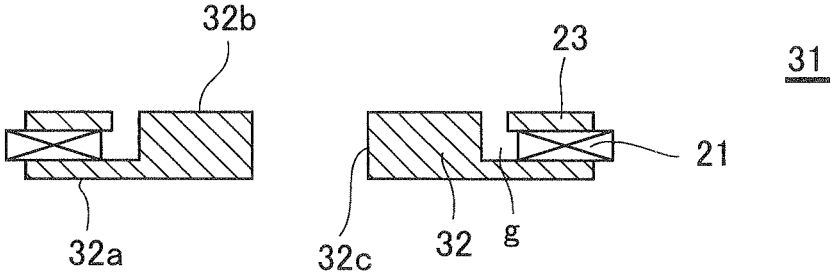

FIG. 6 is a cross-sectional view illustrating the schematic structure of a speaker device according to Embodiment 3 of the present invention. FIG. 7 is a set of schematic diagrams illustrating the structure of a magnetic circuit included in the speaker device shown in FIG. 6. FIG. 7(*a*) is a plan view, FIG. 7(*b*) is a front view, and FIG. 7(*c*) is a cross-sectional view taken along the line C-C in FIG. 7(*a*). The speaker device according to Embodiment 3 is mounted on a portable electronic device such as a mobile phone, a portable radio, or a PDA. The short diameter of the speaker device is, for example, about 2 to 4 cm. The speaker device according to Embodiment 3 includes the vibrating body 1 for an acoustic transducer according to Embodiment 1 above, a magnetic circuit 31, and the frame 12. In FIGS. 6 and 7, parts corresponding to those in FIGS. 1, 2, 4, and 5 are denoted by the same reference numerals, and the description thereof is omitted.

The magnetic circuit 31 shown in FIGS. 6 and 7 is different from the magnetic circuit 11 shown in FIGS. 4 and 5 in that a yoke 32 is newly provided instead of the internal magnet 22 and the yoke 25. More specifically, the magnetic circuit 31 is of the external magnetic type in which the external magnet 21 is sandwiched between the external plate 23 and the yoke 32.

As with the yoke 25, the yoke 32 is formed of a magnetic material such as pure iron, oxygen-free steel, or silicon steel. The yoke 32 has a substantially track-like shape in plan view. More specifically, the outer circumferential shape of the yoke 32 in plan view is geometrically similar to the outer circumferential shape of the external magnet 21 in plan view and is slightly smaller than the outer circumferential shape of the external magnet 21 in plan view in both the long and short axis directions. The yoke 32 includes a bottom plate part 32*a* having a substantially track-like shape in plan view and a pillar part 32*b* that is provided substantially at the center of the bottom plate part 32*a* and has a substantially track-like shape in plan view. The bottom plate part 32*a* is formed integrally with the pillar part 32*b*. A through hole 32*c* having a substantially cylindrical shape is formed substantially at the center (on the inner side) of the pillar part 32*b*. The yoke 32 is fixed on the upper surface of the external magnet 21 using, for example, an adhesive.

As described above, in Embodiment 3 of the present invention, the vibrating body 1 for an acoustic transducer according to Embodiment 1 described above and the magnetic circuit 31 of the external magnetic type constitutes the speaker device. In the vibrating body 1 for an acoustic transducer, the second vibrating part 2*b* is larger than the first vibrating part 2*a*, and the plurality of first reinforcing portions 6*a* and 6*b* are formed so as to extend from the second vibrating part 2*b* to the edge portion 3. In addition, the plurality of second reinforcing portions 8*a* and 8*b* are formed in the edge portion 3. Therefore, according to Embodiment 3 of the present invention, the sensitivity of the speaker device can be increased, and deterioration in the acoustic characteristic of the speaker device can be suppressed. Moreover, the occurrence of unnecessary movement (such as the rolling phenomenon) in the pocket 2*c* in which the voice coil 13 is accommodated can be suppressed.

The embodiments of the present invention have been described with reference to the drawings, but the specific configuration is not limited to these embodiments. Design modifications and other modifications are included in the present invention so long as they do not depart from he subject-matter of the present invention.

The technological features in each embodiment described above can be applied to other embodiments so long as their objects, configurations, and the like do not cause a contradiction and a problem.

The invention claimed is:

1. A vibrating body for an acoustic transducer comprising:
a diaphragm including:
a first vibrating part,
a second vibrating part in the outer side of said first vibrating body, and
an edge portion in outer side of said second vibrating part; and
a reinforcing portion extending from said second vibrating part to said edge portion in a radial direction, wherein:
said second vibrating part includes a first region having a straight outer circumferential part and a second region having a curved outer circumferential part; and
said reinforcing portion is formed in said second region of said second vibrating part.

2. The vibrating body for an acoustic transducer according to claim 1, wherein a second reinforcing portion extending in said radial direction is formed in said edge portion.

3. The vibrating body for an acoustic transducer according to claim 2, wherein:
said edge portion includes a first region and a second region, the first region having a straight inner circumferential part and a straight outer circumferential part, and the second region having a curved inner circumferential part and a curved outer circumferential part; and
a plurality of said second reinforcing portions are formed in said second region of said edge portion.

4. The vibrating body for an acoustic transducer according to claim 2,
wherein an area of said first vibrating part is substantially equal to or less than a sum of an area of said second vibrating part and an area of said edge portion.

5. The vibrating body for an acoustic transducer according to claim 4,
wherein:
said first reinforcing portion is formed so as to be convex in an acoustic radiation direction; and
said second reinforcing portion is formed so as to be convex in a direction opposite to said acoustic radiation direction.

6. The vibrating body for an acoustic transducer according to claim 4, wherein a height of said first reinforcing portion is substantially equal to or less than a height defined as a distance from an outer circumferential portion of said second vibrating part to an apex of said edge portion.

7. The vibrating body for an acoustic transducer according to claim 6, wherein said first reinforcing portion and said second reinforcing portion are disposed alternately.

8. The vibrating body for an acoustic transducer according to claim 7, wherein said first reinforcing portion has a polygonal shape in plan view.

9. The vibrating body for an acoustic transducer according to claim 8, wherein:
said first vibrating part, said second vibrating part, and said edge portion have curved cross-sectional shapes; and
an apex of said second vibrating part is lower than an apex of said first vibrating part or an apex of said edge portion.

10. The vibrating body for an acoustic transducer according to claim 9, wherein an apex of said edge portion is disposed on an outer circumferential side in respect with a center between inner and outer circumferences of said edge portion.

11. The vibrating body for an acoustic transducer according to claim 10, wherein said edge portion includes a bent portion at an outer circumferential portion thereof.

12. A speaker device comprising:
said vibrating body for an acoustic transducer according to claim 1;
a magnetic circuit; and
a frame that supports said vibrating body for an acoustic transducer.

13. The speaker device according to claim 12, wherein said magnetic circuit of an external magnetic type includes a yoke, a magnet, and a plate.

14. An electric device comprising said speaker device according to claim 12.

15. A speaker device comprising:
a frame;
a magnetic circuit;
a voice coil; and
a diaphragm including a track-shaped outer circumferential part, wherein:
the diaphragm includes a vibrating part and an edge part, wherein the vibrating part and the edge part are arranged outside the voice coil;
the vibrating part is supported by the frame via the edge part;
one first reinforcing portion is arranged in the vibrating part and the edge portion;
the first reinforcing portion extends in a long axis direction of the diaphragm;
the vibrating part includes two curved outer circumferential parts arranged in the long axis direction of the diaphragm; and
the first reinforcing portion passes across the curved outer circumferential part of the vibrating part.

16. A speaker device according to claim 15, wherein:

one end of the first reinforcing portion is arranged in the vibrating part side in respect to a top end of the edge part; and the other end of the first reinforcing portion is arranged in the edge part side in respect to an inner circumferential part of the vibrating part.

* * * * *